US010238174B2

(12) United States Patent
Lucca

(10) Patent No.: US 10,238,174 B2
(45) Date of Patent: Mar. 26, 2019

(54) THREE LAYER SHOE CONSTRUCTION WITH IMPROVED CUSHIONING

(71) Applicant: Footwear Unlimited Inc., Fenton, MO (US)

(72) Inventor: Fabio Lucca, Valley Park, MO (US)

(73) Assignee: Footwear Unlimited Inc., Fenton, MO (US)

( * ) Notice: Subject to any disclaimer, the term of this patent is extended or adjusted under 35 U.S.C. 154(b) by 101 days.

(21) Appl. No.: 15/658,581

(22) Filed: Jul. 25, 2017

(65) Prior Publication Data

US 2019/0029364 A1 Jan. 31, 2019

(51) Int. Cl.

| | |
|---|---|
| ***A43B 13/18*** | (2006.01) |
| ***A43B 13/04*** | (2006.01) |
| ***A43B 13/12*** | (2006.01) |
| ***A43B 13/14*** | (2006.01) |
| ***A43B 13/22*** | (2006.01) |
| ***A43B 1/00*** | (2006.01) |
| ***A43B 13/40*** | (2006.01) |
| ***A43B 17/00*** | (2006.01) |

(52) U.S. Cl.

CPC ..... *A43B 13/186* (2013.01); *A43B 1/0045* (2013.01); *A43B 13/04* (2013.01); *A43B 13/122* (2013.01); *A43B 13/125* (2013.01); *A43B 13/127* (2013.01); *A43B 13/141* (2013.01); *A43B 13/188* (2013.01); *A43B 13/223* (2013.01); *A43B 13/40* (2013.01); *A43B 17/00* (2013.01)

(58) Field of Classification Search

CPC ..... A43B 13/12; A43B 13/122; A43B 13/125; A43B 13/127; A43B 13/141; A43B 13/186; A43B 13/188; A43B 13/40; A43B 17/00; A43B 17/006

USPC ..... 36/43, 44, 30 R

See application file for complete search history.

(56) References Cited

U.S. PATENT DOCUMENTS

| | | | | |
|---|---|---|---|---|
| 1,568,064 A | | 1/1926 | Goldman | |
| 2,124,986 A | * | 7/1938 | Pipes | A43B 13/04 36/32 R |
| D278,851 S | * | 5/1985 | Austin | D2/955 |
| 4,641,438 A | | 2/1987 | Laird et al. | |
| 4,794,707 A | | 1/1989 | Franklin et al. | |
| 4,866,861 A | | 9/1989 | Noone | |
| 4,942,679 A | | 7/1990 | Brandon et al. | |
| 5,224,277 A | | 7/1993 | Sang Do | |

(Continued)

*Primary Examiner* — Ted Kavanaugh

(74) *Attorney, Agent, or Firm* — Husch Blackwell LLP

(57) ABSTRACT

A three-layered shoe construction having an outsole with a first flexible area and a second flexible area located in the vicinity of both the forefoot area and the hind foot area, the second flexible area being more flexible than the first flexible area, and further including a cavity housing a plurality of protrusions therewithin; a dual density midsole having a first density in the forefoot area and a second density in the hind foot area, the second density being greater than the first density; and an insole having a top face which includes a plurality of raised projections forming a geometric pattern that starts in the vicinity of the midfoot area and spirals outwardly towards both the toe area and the heel area, the plurality of raised projections increasing in size as they approach the toe and heel areas. The specific construction associated with the outsole, midsole and insole enhance flexibility, cushioning, comfort and breathability.

19 Claims, 5 Drawing Sheets

(56) References Cited

U.S. PATENT DOCUMENTS

| | | | | | |
|---|---|---|---|---|---|
| 5,353,526 | A | | 10/1994 | Foley et al. | |
| 5,400,526 | A | * | 3/1995 | Sessa | A43B 1/0045 36/141 |
| D388,948 | S | * | 1/1998 | Sessa | D2/961 |
| 5,862,614 | A | * | 1/1999 | Koh | A43B 13/223 36/31 |
| 6,038,790 | A | * | 3/2000 | Pyle | A43B 7/1425 36/28 |
| 6,061,929 | A | | 5/2000 | Ritter | |
| 6,161,315 | A | | 12/2000 | Dalton | |
| 6,237,249 | B1 | * | 5/2001 | Aguerre | A43B 3/103 36/11.5 |
| 6,276,073 | B1 | | 8/2001 | Curley, Jr. | |
| 6,705,027 | B1 | | 3/2004 | Campbell | |
| 6,817,117 | B1 | | 11/2004 | Campbell | |
| 7,610,695 | B2 | | 11/2009 | Hay | |
| 7,637,034 | B2 | | 12/2009 | Ailey et al. | |
| D626,321 | S | * | 11/2010 | Cagner | D2/954 |
| 8,322,049 | B2 | * | 12/2012 | Dojan | A43B 13/122 36/103 |
| 2002/0004999 | A1 | | 1/2002 | Caine et al. | |
| 2002/0078598 | A1 | | 6/2002 | Bell | |
| 2005/0217148 | A1 | * | 10/2005 | Connolly | A43B 13/04 36/59 R |
| 2005/0257402 | A1 | * | 11/2005 | Kobayashi | A43B 5/10 36/59 R |
| 2007/0277401 | A1 | | 12/2007 | Young-Chul | |
| 2009/0090031 | A1 | | 4/2009 | Jung | |
| 2009/0188131 | A1 | | 7/2009 | Doerer et al. | |
| 2009/0307932 | A1 | | 12/2009 | Kirby et al. | |

* cited by examiner

THREE LAYER SHOE CONSTRUCTION WITH IMPROVED CUSHIONING

FIELD OF THE INVENTION

The present invention relates to a shoe construction and, more particularly, to a three layered shoe construction with an outsole having a unique exterior face to enhance flexibility and comfort, a dual density midsole, and an insole having a raised pattern for increased breathability and comfort coupled with a raised arch area for providing additional support to the arch of the foot.

BACKGROUND OF THE INVENTION

Numerous shoes, covering a broad range of different designs and styles have been manufactured and sold in the marketplace. While shoes are worn to provide protection to one's feet, to reduce the impact felt when walking on hard surfaces, to provide support for the feet, and to prevent pronation, shoe designers must still seek to provide optimum levels of stability and comfort. In order to accomplish all of these objectives, shoe designers have used a wide variety of different tools and methods including heel plugs, shanks, contoured soles, deformable pillars or columns, spring-like structures, different traction designs, cushioning members, different shank designs, different ventilation structures, rocker elements, pads, gels and sole constructions having a plurality of different layers. Although these methods can be effective, the large number of components can result in increased manufacturing costs and complexity. It is therefore desirable to improve cushioning, flexibility, support and stability without increasing the number of components to achieve the same level of comfort for the user.

SUMMARY OF THE INVENTION

The present invention is directed to a three layer shoe construction which includes an outsole, midsole, and insole. The three layers have a mating relationship which will be later described in detail. The three components of the present shoe are preferably secured together through conventional means such as through cementing and/or adhesives thereby preventing relative movement between the layers during assembly and use of the present shoe. Each of the three layers of the present shoe are generally in the shape of a human foot and can be divided into different sections according to the three different regions of the human foot—the forefoot, the midfoot, and the hind foot. The forefoot is generally adjacent to and includes the toe area;, the hind foot is generally adjacent to and also includes the heel area; and the midfoot is located adjacent to both the forefoot and the hind foot. The ball of the foot is generally the area of the foot at the juncture between the metatarsal bones and the phalange bones. The two primary regions of the foot for load bearing when walking or standing normally are the ball area and the heel area, and the major bending of the shoe during normal use is typically in the ball area. The arch or instep is positioned between the heel and ball areas, and flexes very little when walking normally.

The present outsole is made out of a super lightweight thermoplastic rubber (TPR) and includes an exterior and interior face. The exterior face of the present outsole engages the ground or other walking surfaces, while the interior face is located opposite the exterior face and has a mating relationship with the midsole as will be hereinafter further described in more detail.

The exterior face of the present outsole includes a first section and a second section with generally horizontal specific ribbing located and positioned at the forefoot and hind foot areas of the outsole respectively. More specifically, the ribbing includes a plurality of angled and/or slightly arcuate projections that form a traction pattern on the exterior face of the outsole. The first section and second section each further includes a plurality of grooves which intersect with the specific ribbing only on opposite portions of each section. In other words, the plurality of grooves on the first section is located on the proximal half of the forefoot, while the plurality of grooves on the second section is located on the distal half of the hind foot. The specific ribbing and plurality of grooves on each of the first and second sections creates a first flexible area and a second flexible area on each such section wherein the second flexible area is greater than the first flexible area. Each of the second flexible areas has a plurality of grooves which intersect with the specific ribbing, while each of the first flexible areas do not include the intersecting grooves. Those portions of the first and second sections of the outsole which include the second flexible area are necessary because when stepping naturally, a person's foot should land softly on the heel, roll immediately through the outside edge of the foot, across the ball of the foot, and push off from the toe area thereby giving a person a powerful push forward and allowing a person to stride smoothly into the next step. The specific ribbing and plurality of grooves in each section of the exterior face of the outsole enhances traction while still providing for additional flexibility needed to allow the foot to roll through each step and push off normally while walking or running.

The interior face of the present outsole has a cavity located therewithin substantially in the same shape as the outsole. The cavity on the interior face of the outsole has a plurality of horizontal wave-like protrusions associated with the forefoot area and part of the midfoot area, while the remaining part of the midfoot area and the hind foot area include a plurality of straight protrusions. The plurality of wave-like and straight protrusions allow for additional flexibility and shock absorption in the outsole. The plurality of wave-like protrusions also diffuse weight across the ball of the foot.

The present midsole is made of a dual density blown ethylene-vinyl acetate copolymer (EVA) with an intrinsic molded arch support which supports the arch of the foot. The EVA creates a lightweight and resilient midsole which helps dissipate shock when walking or running. In addition to the material itself, the dual density of the midsole allows for greater flexibility and cushioning in the forefoot area due to its lighter density, and provides greater support and stability in the hind foot area due to its heavier density. The sidewall of the midsole has a raised projection extending around its circumference, which projection rises into a bell-shaped curve approximately between the midfoot and hind foot areas on both the distal and proximal sides of the midsole. This raised projection also helps to dissipate shock. Additionally, there are two types of scored patterns associated with the outer circumference of the present midsole, one pattern being located on one side of the raised projection and the other pattern being located on the opposite side of the raised projection. The first scored pattern is diamond-shaped and is located above the raised projection on the midsole while the second scored pattern is a series of horizontal raised lines and is located below the raised projection on the midsole. Both of these scored patterns also help absorb and dissipate shock.

The midsole has a proximal and distal face. Both the proximal and distal faces have a lip around the entire circumference of the midsole thereby creating a first cavity on the distal face which is substantially in the shape of the outsole and creating a second cavity on the proximal face which is substantially in the shape of the insole. The outsole has a mating relationship with the midsole wherein the outsole mates with and is received by the first cavity created by the lip on the distal face of the midsole. Similarly, the insole also has a mating relationship to the midsole wherein the insole mates with and is received by the second cavity created by the lip on the proximal face of the midsole. The three layers are preferably secured together in a conventional manner to prevent movement when worn.

The present insole is made of a lightweight, thermal molded EVA with an antimicrobial shield which provides protection against bacteria, fungus, and controls or eliminates odors, stains, and product deterioration. This can be accomplished by adding a powder or other antimicrobial agents during the manufacturing process. The insole has a top face and a bottom face, wherein the top face engages with the foot of a wearer and has a plurality of raised diamond shaped projections that provide both a cushioning effect and greater breathability when the present shoe is worn. In one embodiment, the raised diamond shaped projections cover the entire top face of the insole except for the arch portion. More particularly, the raised diamond shaped projections have a geometric pattern wherein the pattern starts in the vicinity of the midfoot area approximately adjacent to the arch and spirals outwardly towards both the heel and toe areas creating larger and larger diamond shaped projections as the pattern approaches the heel and toe areas. The arch, on the other hand, includes a series of U-shaped grooves whose center is located and positioned approximately adjacent to and opposite the starting point of the geometric pattern of raised diamond shaped projections. The series of U-shaped grooves are located and positioned closer to one another at their center, while the outer portions of the U-shaped grooves are located and positioned further apart thereby providing both comfort and additional support for the arch of the foot.

The present three layer shoe construction absorbs shock, enhances comfort, and creates a unique propulsion effect, without requiring a vast number of components.

BRIEF DESCRIPTION OF THE DRAWINGS

For a better understanding of the various embodiments of the present invention, reference may be made to the accompanying drawings in which.

Figure 1:
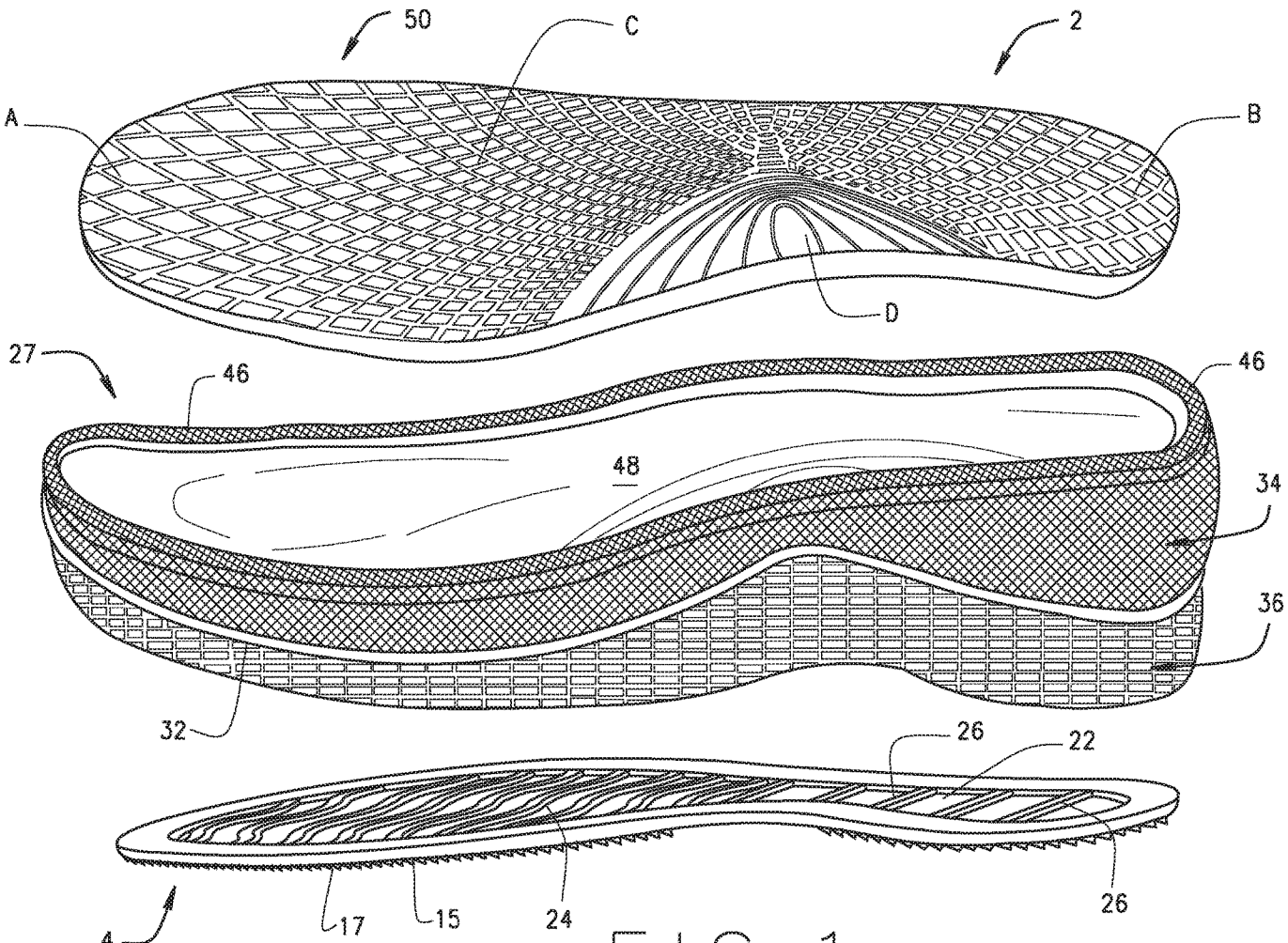
FIG. 1 is an exploded perspective view illustrating a shoe structure constructed according to the teachings of the present invention.

While the disclosure is susceptible to various modifications and alternative forms, specific embodiments thereof are shown by way of example in the drawings and will hereinafter be described in detail. It should be understood, however, that the drawings and detailed description presented herein are not intended to limit the disclosure of the present invention to the particular embodiment disclosed, but on the contrary, the intention is to cover all modifications, equivalents, and alternatives falling within the spirit and scope of the present disclosure.

DETAILED DESCRIPTION OF THE DRAWINGS

The present invention will now be described with reference to the drawing figures in which like reference numerals refer to like parts throughout the disclosure. For purposes of clarity in illustrating the characteristics of the present invention, proportional relationships of the elements have not necessarily been maintained in the drawing figures.

As illustrated in FIG. 1, a three layer shoe construction 2 constructed in accordance with the teachings of the present invention includes an outsole 4, a midsole 27, and an insole 50. The outsole 4, midsole 27, and insole 50 have a mating relationship to each other as will be hereinafter further described. The combination of the three layers provides a unique cushioning and energizing propulsion effect, giving the wearer a sense of bouncing off of the ground. The layers of the present shoe are preferably secured together in a conventional manner such as through cementing and/or adhesives thereby preventing relative movement between the layers during assembly and use of the present shoe.

Each of the three layers of the present shoe are generally in the shape of a human foot and can be divided into different sections according to three distinct regions of the human foot—the forefoot, midfoot, and hind foot. The forefoot area or region of the foot is approximately adjacent to and includes the toe area A, while the hind foot area or region of the foot is approximately adjacent to and includes the heel area B. The midfoot area or region is approximately adjacent to both the forefoot and hind foot region as illustrated in FIG. 1 and includes the arch D. The ball area C of the foot is generally the area of the foot at the juncture between the metatarsal bones and the phalange bones. The two primary regions of the foot for load bearing when walking or standing normally includes the ball area C and the heel area B, and the major bending of the shoe during normal use is typically in the vicinity of the ball area C. The arch or instep area D is located between the heel area B and ball area C, and flexes very little when walking normally.

Figure 2:
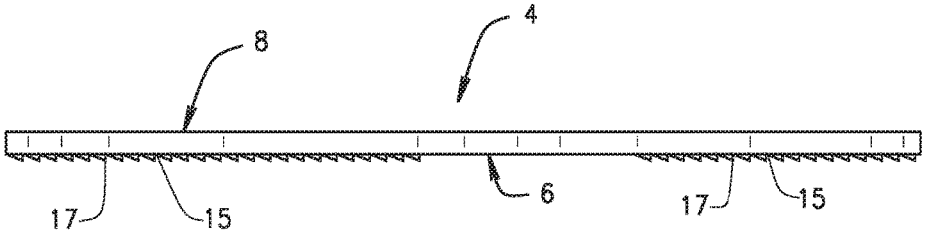
FIG. 2 is a side elevation view of the outsole of FIG. 1.
Figure 3:
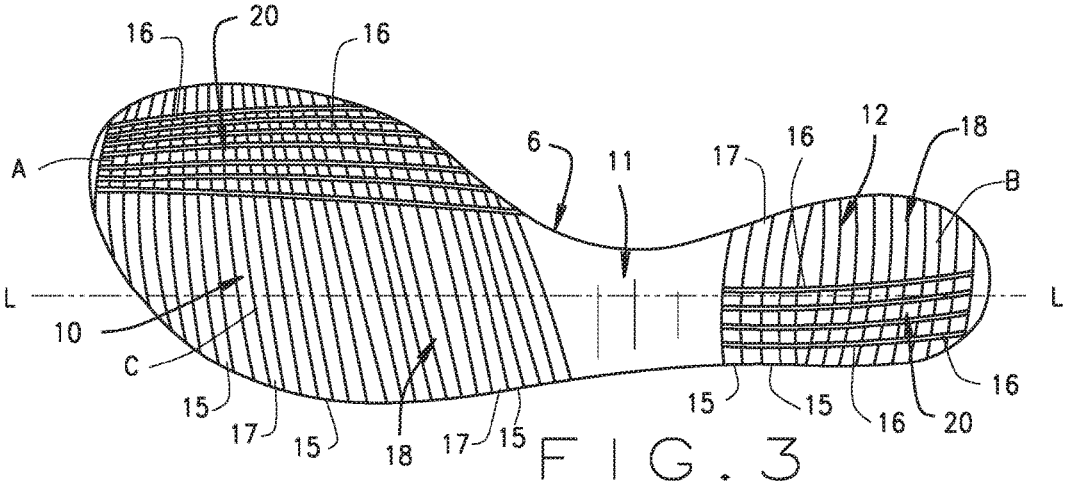
FIG. 3 is a bottom plan view of the outsole of FIGS. 1 and 2.
Figure 4:
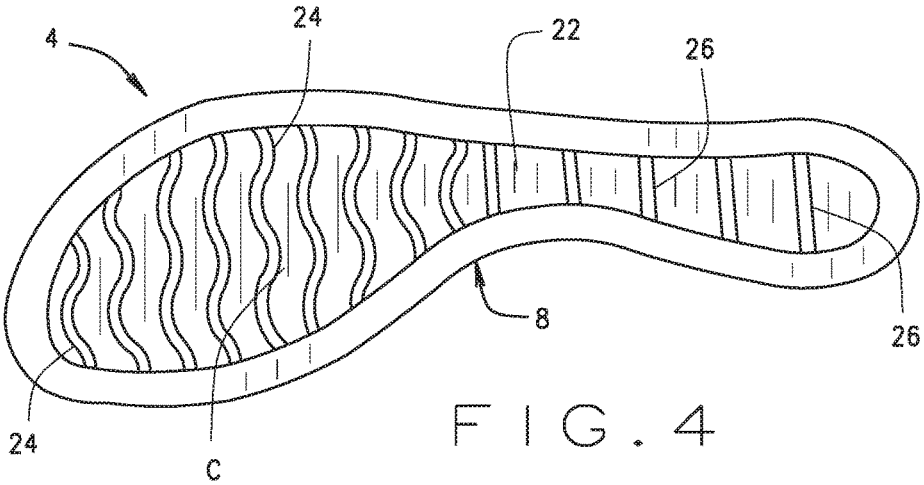
FIG. 4 is a top plan view of the outsole of FIGS. 1, 2, and 3.

The present outsole 4 is made out of a super lightweight thermoplastic rubber (TPR) and has an exterior face 6 and an interior face 8 as seen in FIGS. 2-4. The exterior face 6 of the outsole 4 engages with the ground or other walking surfaces, while the interior face 8 has a mating relationship with the midsole 27 as will be hereinafter described in more detail.

Figure 7:
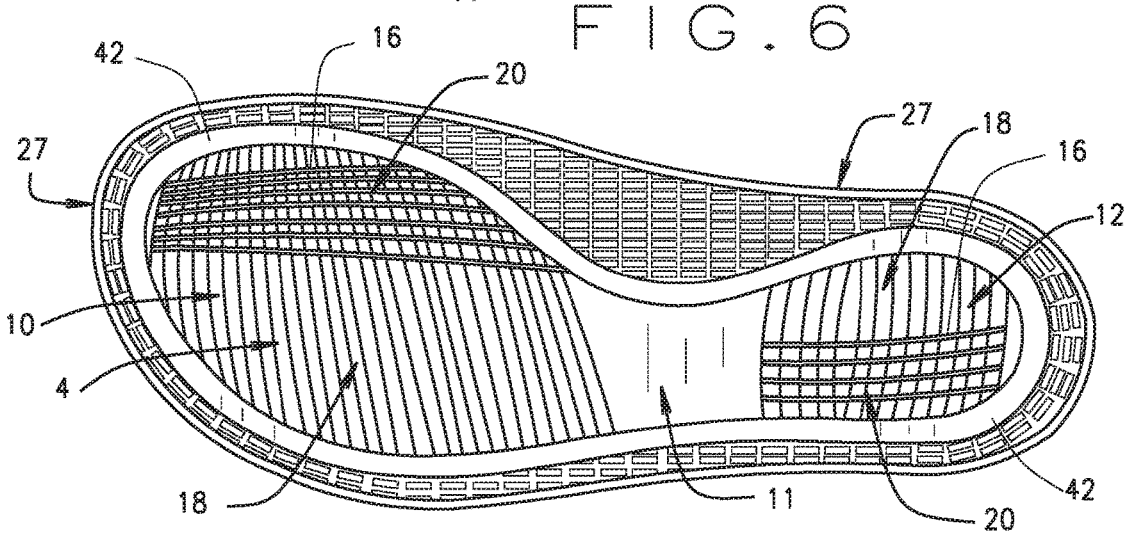
FIG. 7 is a bottom plan view of the outsole and midsole of FIGS. 1-6 mated together.

In one embodiment, the exterior face 6 of the outsole 4 has a first section 10, a second section 11, and a third section 12, divided approximately into the forefoot, midfoot, and hind foot areas respectively as best illustrated in FIGS. 3 and 7. The first section 10 and third section 12 have generally horizontal specific ribbing 14, while the second section 11 is generally smooth. More specifically, the ribbing 14 of the first section 10 and third section 12 includes a plurality of angled or slightly arcuate raised projections 17 that form a traction pattern as illustrated. Each projection 17 in ribbing 14 is formed by a pair of corresponding grooves 15. Some of the raised projection 17 in first section 10 are angled relative to the longitudinal axis L through the outsole 4 and some of the projectors 17 are slightly arcuate. The same is likewise true with respect to the projections 17 located in the third section 12.

Referring again to FIGS. 3 and 7, the first section 10 and third section 12 each further includes a plurality of grooves 16 which intersect with the specific ribbing 14 at an angle of approximately between 45-135 degrees, but only on opposite portions of each section 10 and 12. In other words, the plurality of grooves 16 on the first section 10 is located on the proximal half of the forefoot area while the plurality of grooves 16 on the third section 12 is located on the distal half of the hind foot area. The specific ribbing 14 and plurality of grooves 16 on each of sections 10 and 12 creates a first flexible area 18 and a second flexible area 20 on each outsole section 10 and 12. Since the second flexible area 20 includes the intersecting grooves 16, the second flexible area 20 has a greater flexibility as compared to the first flexible area 18 which does not include the intersecting grooves 16. The second flexible area 20 in each section 10 and 12 allows a person to stride smoothly through each step by allowing a person's foot to land softly on the heel B, roll immediately through the outside edge of the foot, across the ball area C of the foot, and push off from the toe area A thereby giving a person a powerful push forward and allowing a person to stride smoothly into the next step. The second flexible area 20 in each outsole section 10 and 12 enhances traction while still providing for additional flexibility needed to allow the foot to roll through each step with comfort.

Turning to FIG. 4, the interior face 8 of the outsole 4 includes a cavity 22 located therewithin substantially in the same shape as the outsole 4. The cavity 22 includes a plurality of horizontal wave-like protrusions 24 located in the forefoot area and extend partly into at least a portion of the midfoot area while the remainder of the midfoot area and the hind foot area includes a plurality of straight protrusions 26. The wave-like protrusions 24 and straight protrusions 26 protrude from the cavity 22 to the same height as the outsole 4 and allow for additional flexibility and shock absorption in the outsole. The plurality of wave-like protrusions 24 also diffuse weight across the ball area C of the foot. The outsole 4, therefore, provides extra flexibility, comfort, and diffuses the weight of the wearer across the ball area C of the foot.

Figure 9:
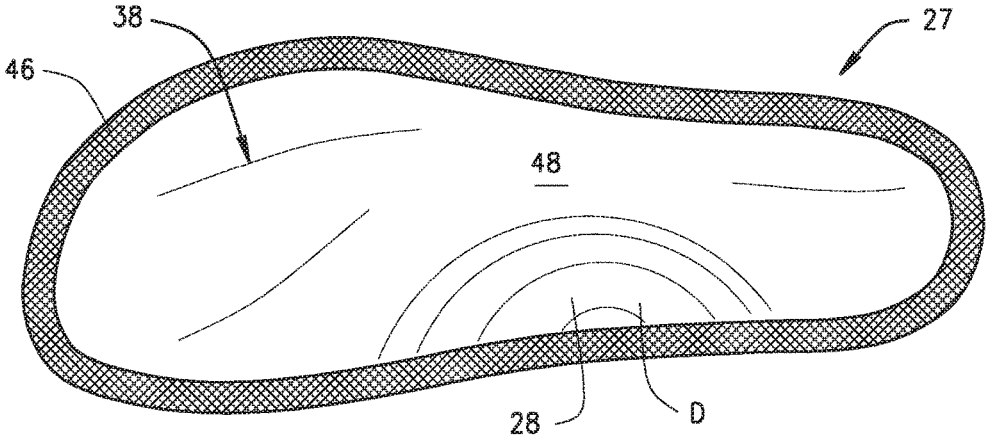
FIG. 9 is a top plan view of the midsole of FIGS. 1 and 5-8.

As shown in FIG. 9, the midsole 27 is made of a dual density blown ethylene-vinyl acetate copolymer (EVA) with an intrinsic molded arch support 28. The raised arch area of the intrinsic molded arch support 28 provides additional support for the arch D of the foot. The EVA creates a lightweight and resilient midsole 27, which helps dissipate shocks when walking or running In addition to the material itself, the dual density of the midsole 27 allows for greater flexibility and cushioning in the forefoot area due to its lighter density and, at the same time, provides greater support and stability in the hind foot area due to its heavier density. In simple terms, the forefoot area of the present midsole 27 has a lighter density as compared to a heavier density heel area.

Figure 5:
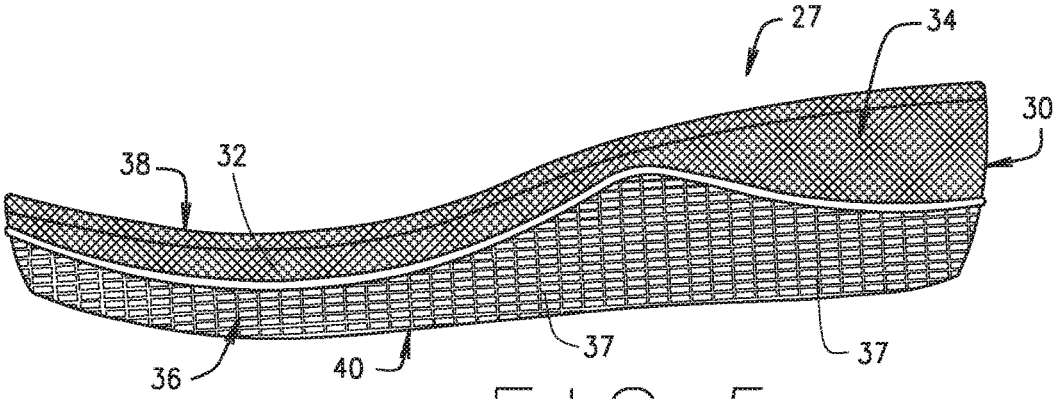
FIG. 5 is a side elevation view of the midsole of FIG. 1.
Figure 8:
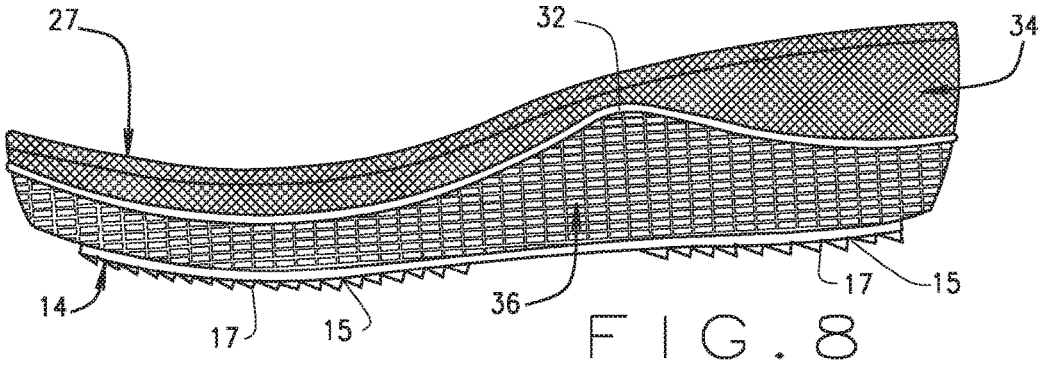
FIG. 8 is side elevation view of the outsole and midsole of FIGS. 1-7.

The sidewall 30 of the midsole 27 includes a raised projection 32 which extends completely around its circumference and rises into a bell-shaped curve approximately between the midfoot and hind foot areas on both the distal and proximal sides of the midsole 27 as best illustrated in FIGS. 1, 5, and 8. The raised projection 32 also helps to dissipate shock and forms a separation member between two different types of scored patterns associated with the circumference of the midsole 27. The first scored pattern 34 is located above raised projection 32 and includes diamond-shaped projection pattern. The second scored pattern 36 includes a series of raised horizontal lines 37 and is located below the raised projection 32. Both of these scored patterns also help absorb and dissipate shock.

Figure 6:
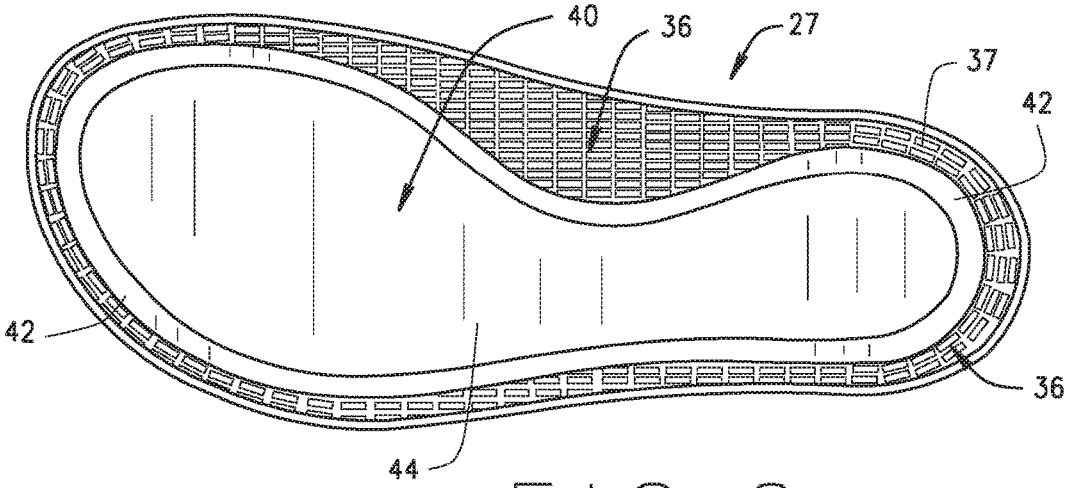
FIG. 6 is bottom plan view of the midsole of FIGS. 1 and 5.
Figure 10:
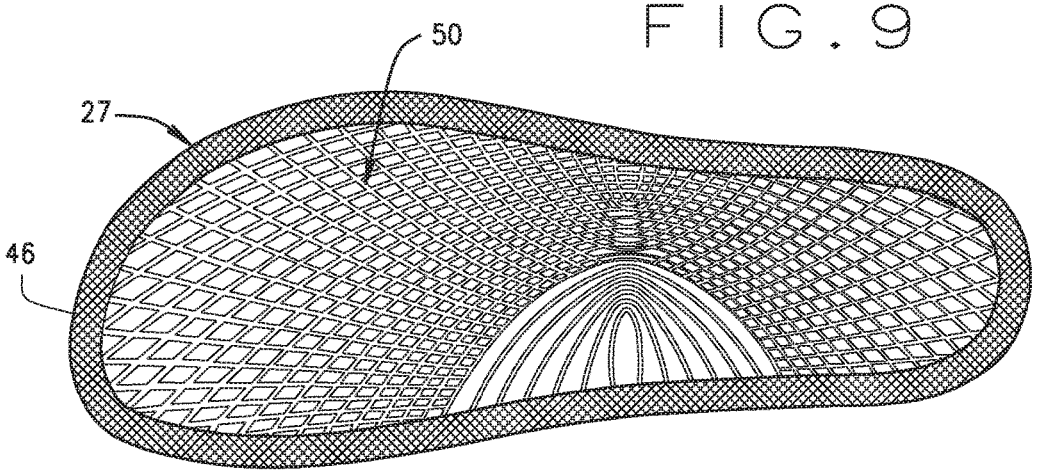
FIG. 10 is a top plan view of the midsole and insole of FIGS. 1, 5, and 6 mated together.

The midsole 27 has both a proximal face 38 and a distal face 40 as best seen in FIG. 5. Turning to FIG. 6, the distal face 40 has a lip 42 around the entire circumference of the midsole 27, creating a first cavity 44 generally in the shape of the outsole 4. The outsole 4 has a mating relationship with the midsole 27 wherein the outsole 4 mates with and is received by the first cavity 44 created by the lip 42 on the distal face 40 as shown in FIGS. 7 and 8. Substantially similar to the distal face 40, the proximal face 38 of midsole 27 also includes a lip 46 around the entire circumference of the midsole 27 thereby creating a second cavity 48 as seen in FIG. 9. The cavity 48 is generally in the shape of insole 50 and is likewise dimensioned to mate with and receive the insole 50 as best illustrated in FIG. 10.

Figure 11:
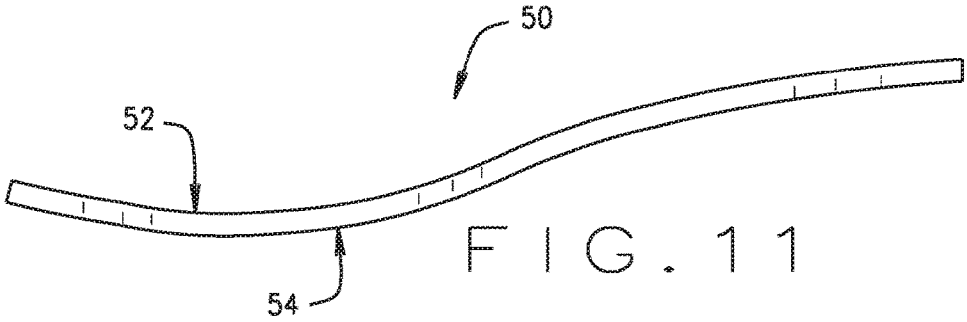
FIG. 11 is a side elevation view of the insole of FIGS. 1 and 10.
Figure 12:
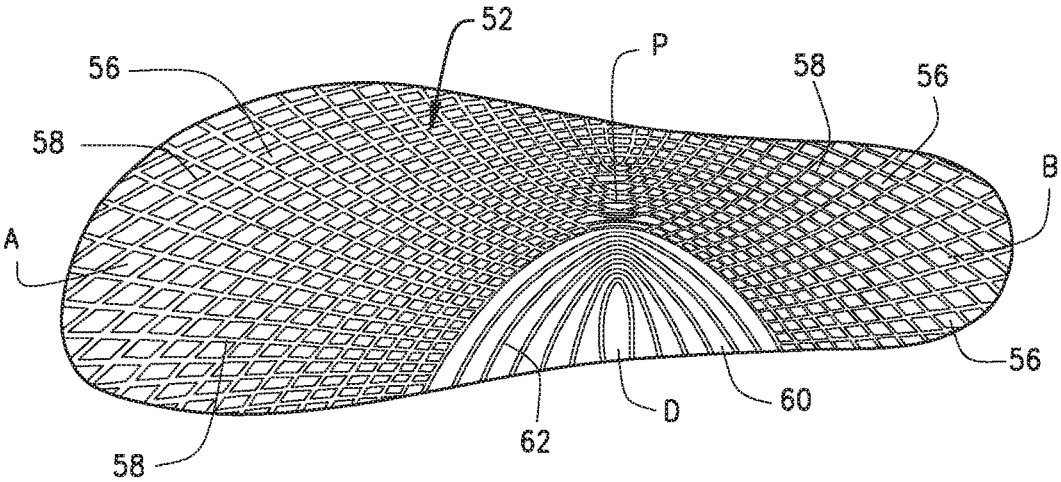
FIG. 12 is a top plan view of the insole of FIGS. 1, 10, and 11.

As illustrated in FIGS. 11 and 12, the insole 50 is made of a lightweight, thermal molded EVA with an antimicrobial shield which provides protection against bacteria, fungus, and controls or eliminates odors, stains, and product deterioration. This can be accomplished by adding a powder or other antimicrobial agents during the manufacturing process. The insole 50 has a top face 52 and a bottom face 54, wherein the top face 52 engages with the foot of a wearer and includes a plurality of raised diamond shaped projections 56 that extend over most of the top face 52 and provide a cushioning effect. In between the diamond shaped projections 56, there is a plurality of indentations or grooves 58 that allow for greater breathability when the shoe is worn.

Figure 13:
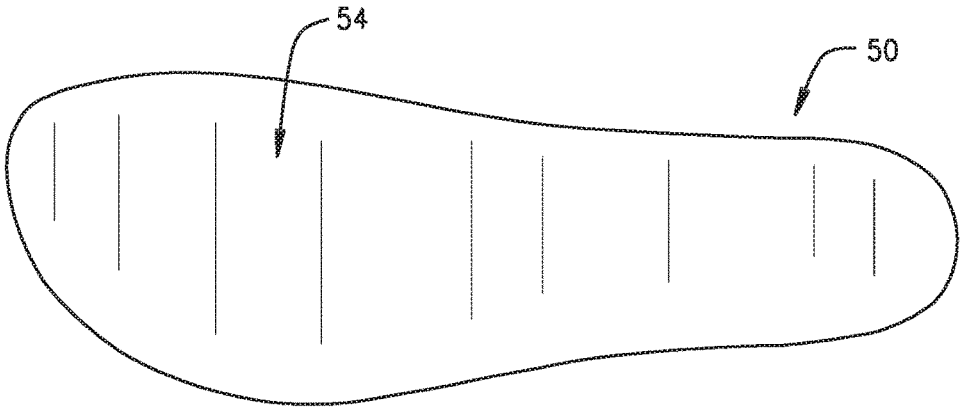
FIG. 13 is a bottom plan view of the insole of FIGS. 1, 11, 12.

In one embodiment, the raised diamond shaped projections 56 cover the entire top face 52 of the insole 50 except for the arch portion D. The raised diamond shaped projections 56 have a geometric pattern wherein the pattern starts in the midfoot area or approximately adjacent to the arch D and spirals or fans outwardly towards both the heel area B and the toe area A creating larger and larger diamond-shaped projections 56 as the pattern approaches the heel and toe areas B and A. The arch area D, on the other hand, includes a series of U-shaped projections 60 and a series of U-shaped grooves 62 located therebetween. The series of U-shaped projections 60 and U-shaped grooves 62 have a center which is located and positioned approximately adjacent to and opposite the starting point P of the geometric pattern of raised diamond shaped projections 56 in the vicinity of the midfoot area and approximately in the center of the arch area D. The series of U-shaped grooves 62 are located and positioned closer to one another at their center, while the outer portions of the U-shaped grooves 62 are located and positioned further apart as best seen in FIGS. 10 and 12. Finally, unlike the top face 52 of the insole 50, the bottom face 54 is substantially smooth as illustrated in FIG. 13. The combination of the outsole 4, midsole 27, and insole 50 allows for great shock absorption, cushioning, flexibility and also produce a unique energizing propulsion effect.

From the foregoing, it will be seen that the various embodiments of the present invention are well adapted to attain all the objectives and advantages hereinabove set forth together with still other advantages which are obvious and which are inherent to the present structures. It will be understood that certain features and sub-combinations of the present embodiments are of utility and may be employed without reference to other features and sub-combinations. Since many possible embodiments of the present invention may be made without departing from the spirit and scope of the present invention, it is also to be understood that all disclosures herein set forth or illustrated in the accompanying drawings are to be interpreted as illustrative only and not limiting. The various constructions described above and illustrated in the drawings are presented by way of example only and are not intended to limit the concepts, principles and scope of the present invention.

Many changes, modifications, variations and other uses and applications of the present invention will, however, become apparent to those skilled in the art after considering the specification and the accompanying drawings. All such changes, modifications, variations and other uses and applications which do not depart from the spirit and scope of the invention are deemed to be covered by the invention which is limited only by the claims which follow.

What is claimed is:

1. A shoe construction comprising:

an outsole having an exterior face, an interior face, a forefoot area, a midfoot area and a hind foot area, the exterior face including a first section located in the vicinity of the forefoot area and a second section located in the vicinity of the hind foot area, each of said first and second sections including a plurality of raised ribs, the first section further including a plurality of grooves which intersect said plurality of raised ribs in the vicinity of the proximal portion of the forefoot area and the second section further including a plurality of grooves which intersect said plurality of raised ribs in the vicinity of the distal portion of the hind foot area;

a midsole having a proximal face, a distal face, a forefoot area and a hind foot area, the midsole having a first density in the forefoot area and a second density in the hind foot area, the midsole having a first cavity located and positioned on its distal face and a second cavity located and positioned on its proximal face; and an insole having a top face, a bottom face, a toe area, a midfoot area and a heel area, the top face of the insole including a plurality of raised projections forming a geometric pattern that starts in the vicinity of the midfoot area and spirals outwardly towards both the toe area and the heel area, the plurality of raised projections increasing in size as they approach the toe and heel area;

the first cavity on the midsole being shaped and dimensioned to receive the outsole and the second cavity on the midsole being shaped and dimensioned to receive the insole.

2. The shoe construction of claim 1 wherein the interior face of the outsole includes a cavity, the cavity including a plurality of protrusions which extend across the interior face of the outsole.

3. The shoe construction of claim 1 wherein the midsole includes a sidewall extending completely around the perimeter of the midsole, the sidewall including a raised projection.

4. The shoe construction of claim 3 wherein the sidewall further includes a first scored pattern located on one side of the raised projection and a second scored pattern located on the opposite side of the raised projection.

5. The shoe construction of claim 1 wherein the plurality of raised projections on the top face of the insole are diamond shaped projections.

6. The shoe construction of claim 1 wherein the insole includes an arch area, the top face of the insole further including a series of U-shaped projections and a series of U-shaped grooves in the arch area.

7. The shoe construction of claim 1 wherein the outsole is made of a super lightweight thermoplastic rubber (TPR).

8. The shoe construction of claim 1 wherein the midsole is made of a dual density ethylene-vinyl acetate copolymer (EVA).

9. The shoe construction of claim 1 wherein the insole is made of a lightweight thermal molded EVA.

10. A three-layered shoe construction comprising:

an outsole having an exterior face, an interior face, a proximal side, and a distal side, the exterior face including a first section, a second section, and a third section, each of said first and third sections including a plurality of raised ribs, the first section further including a plurality of groves which intersect said plurality of raised ribs in the vicinity of the proximal side of the outsole, the third section further including a plurality of groves which intersect said plurality of raised ribs in the vicinity of the distal side of the outsole, and the second section being smooth and being located between the first and third sections on the exterior face of the outsole;

the interior face of the outsole including a cavity, said cavity including a plurality of protrusions extending across the interior face of the outsole within said cavity;

a midsole having a proximal face, a distal face, a forefoot area and a hind foot area, the midsole having a first density in the forefoot area and a second density in the hind foot area, the midsole further having a first cavity located and positioned on its distal face and a second cavity located and positioned on its proximal face;

an insole having a top face, a bottom face, a toe area, a midfoot area, a heel area, and an arch area, the top face of the insole including a plurality of raised projections forming a geometric pattern that starts in the vicinity of the midfoot area and fans outwardly towards both the toe area and the heel area, the plurality of raised projections increasing in size as they approach the toe and heel areas, the top face further including a series of U-shaped projections and a series of U-shaped groves located in the vicinity of the arch area of the insole;

the first cavity of the midsole being shaped and dimensioned to receive the outsole and the second cavity of the midsole being shaped and dimensioned to receive the insole.

11. The shoe construction of claim 10 wherein the plurality of protrusions extending across the interior face of the outsole includes a plurality of wavy projections positioned and located in the vicinity of the forefoot area and a plurality of straight projections positioned and located in the vicinity of the hind foot area.

12. The shoe construction of claim 10 wherein the midsole includes a sidewall extending circumferentially around the perimeter of the midsole, said sidewall including a raised projection.

13. The shoe construction of claim 12 wherein the sidewall further includes a first scored pattern located on one side of the raised projection and a second scored pattern located on the opposite side of the raised projection.

14. The shoe construction of claim 10 wherein the plurality of raised ribs associated with each of said first and third sections of the exterior face of the outsole form a first flexible area and wherein the plurality of groves which intersect the plurality of raised ribs associated with the first and third sections of the exterior face of the outsole form a second flexible area, the second flexible area of said outsole being more flexible than the first flexible area of the outsole.

15. A three-layered shoe construction having a forefoot area, a midfoot area, a hind foot area, an arch area, a toe area, and a heel area, the shoe construction comprising:

an outsole having an exterior face and an interior face, the exterior face including a first section located in the vicinity of the forefoot area, a second section located in the vicinity of the midfoot area, and a third section located in the vicinity of the hind foot area, each of said first and third sections including the plurality of raised ribs which form a first flexible area associated with each of said first and third sections, the first and third sections further including a plurality of groves which intersect said plurality of raised ribs forming a second flexible area associated with each of said first and third sections, the second flexible area associated with said first section being located in the vicinity of the proximal side of the forefoot area while the second flexible area associated with the third section being located in the vicinity of the distal side of the hind foot area, said second flexible area being more flexible than the first flexible area;

the interior face of the outsole including a cavity having a plurality of protrusions positioned therewithin, at least some of the plurality of protrusions positioned and located in the forefoot area of the outsole being wave-like in shape and at least some of the protrusions located in the hind foot area of the outsole being straight in shape;

a midsole having a proximal face and a distal face, the midsole having a first density in the forefoot area and a second density in the hind foot area wherein the second density is greater than the first density, the midsole further including a sidewall extending completely around the perimeter thereof, said sidewall including a raised projection extending around the perimeter thereof, said sidewall further including a first scored pattern located above the raised projection and a second scored pattern located below the raised projection, the midsole further including a first cavity positioned and located on its distal face and a second cavity positioned and located on its proximal face; and an insole having a top face and a bottom face, the top face of the insole including a plurality of raised projections forming a geometric pattern that starts in the vicinity of the midfoot area and spirals outwardly toward both the toe area and the heel area, the plurality of raised projections increase in size as they approach the heel and toe areas, the top face further including a series of U-shaped projections and a series of U-shaped groves positioned and located in the arch area, the series of U-shaped projections and groves having a center which is located and positioned in the vicinity of the center of the arch area, the series of U-shaped groves and projections being located closer to one another at the center as compared to other portions of the U-shaped groves and projections;

the first cavity of the midsole being shaped and dimensioned to receive the outsole and the second cavity of the midsole being shaped and dimensioned to receive the insole.

16. The shoe construction of claim 15 wherein the first scored pattern located above the raised projection on the sidewall of the midsole includes a diamond-shaped projection pattern, and wherein the second scored pattern located below the raised projection on the sidewall of the midsole includes a series of raised horizontal lines.

17. The shoe construction of claim 15 wherein the second section of the exterior face of the outsole is smooth.

18. The shoe construction of claim 15 wherein the plurality of raised projections associated with the top face of the insole area diamond-shaped projections.

19. The shoe construction of claim 15 wherein the insole includes an antimicrobial shield.

* * * * *